US009789374B2

(12) United States Patent
Trombley et al.

(10) Patent No.: US 9,789,374 B2
(45) Date of Patent: Oct. 17, 2017

(54) ATHLETIC TRAINING SYSTEM

(71) Applicants: Steve Trombley, Penn Yan, NY (US); Kevin Donahue, Camillus, NY (US)

(72) Inventors: Steve Trombley, Penn Yan, NY (US); Kevin Donahue, Camillus, NY (US)

( * ) Notice: Subject to any disclaimer, the term of this patent is extended or adjusted under 35 U.S.C. 154(b) by 0 days.

(21) Appl. No.: 14/592,312

(22) Filed: Jan. 8, 2015

(65) Prior Publication Data

US 2015/0190698 A1 Jul. 9, 2015

Related U.S. Application Data

(60) Provisional application No. 61/924,800, filed on Jan. 8, 2014.

(51) Int. Cl.

| | |
|---|---|
| ***A63B 69/00*** | (2006.01) |
| ***A63B 71/02*** | (2006.01) |
| ***A63B 102/14*** | (2015.01) |

(52) U.S. Cl.

CPC ..... *A63B 69/00* (2013.01); *A63B 2071/026* (2013.01); *A63B 2102/14* (2015.10); *A63B 2210/50* (2013.01)

(58) Field of Classification Search

CPC . A63B 69/00; A63B 2210/50; A63B 2102/14; A63B 2071/026

USPC ..... 473/454, 446, 430, 422, 228, 218; 248/168; 239/280.5

See application file for complete search history.

(56) References Cited

U.S. PATENT DOCUMENTS 675,456 A * 6/1901 Voorhees ..... A63F 7/0628 273/108.2
1,493,934 A * 5/1924 Grau ..... A63F 7/0628 273/317.2
1,537,649 A * 5/1925 McGlashan ..... B60J 1/04 16/335
2,824,742 A * 2/1958 Fortin ..... A63B 69/3676 473/229
3,166,316 A * 1/1965 O'Leary ..... A63B 69/0079 273/DIG. 7
3,850,401 A * 11/1974 Snediker ..... A47B 97/02 211/101
4,516,771 A * 5/1985 Nau ..... A63B 69/0002 473/453
5,388,794 A * 2/1995 Wolff ..... G09F 17/00 248/219.4
5,485,993 A * 1/1996 Lipsett ..... A63B 69/0071 473/448
5,509,629 A * 4/1996 Sassmannshausen . F16M 11/16 248/169
5,674,157 A * 10/1997 Wilkinson ..... A63B 5/11 482/27
5,769,742 A * 6/1998 Bristow ..... A63B 69/34 473/446

(Continued)

*Primary Examiner* — Gene Kim
*Assistant Examiner* — Jeffrey Vanderveen
(74) *Attorney, Agent, or Firm* — Bay State IP, LLC

(57) ABSTRACT

An athletic training system and apparatuses which allows a user to practice several important skills needed to be successful in the game of lacrosse and of highest import affords user the ability to practice gaining possession of a ball at the beginning of the game and back after each score. The specifically designed structural elements of this device allow a player to practice endless repetitions of face-off and draw skills, while challenging the player to improve their form and quickness.

11 Claims, 8 Drawing Sheets

(56) References Cited

U.S. PATENT DOCUMENTS

| | | | | |
|---|---|---|---|---|
| 6,019,484 | A * | 2/2000 | Seyler | F21L 14/04 362/287 |
| 6,378,820 | B1 * | 4/2002 | Mooney | G09F 17/00 116/173 |
| 6,546,923 | B2 * | 4/2003 | Erickson | A63B 69/407 124/16 |
| 7,070,520 | B1 * | 7/2006 | An | A63B 69/0091 473/139 |
| 8,167,743 | B1 * | 5/2012 | Kangas | A63B 69/345 473/422 |
| 9,381,416 | B2 * | 7/2016 | Stojanovic | A63B 69/0075 |
| 2002/0165049 | A1 * | 11/2002 | Dadbeh | A63B 63/083 473/483 |
| 2007/0060419 | A1 * | 3/2007 | Hutton | A63B 69/00 473/446 |
| 2009/0284963 | A1 * | 11/2009 | Intravatola | F16M 11/28 362/190 |
| 2013/0106057 | A1 * | 5/2013 | Perry, Jr. | A63B 69/407 273/317 |
| 2015/0087447 | A1 * | 3/2015 | Salway | A63B 69/0024 473/446 |
| 2015/0190698 | A1 * | 7/2015 | Trombley | A63B 69/00 473/446 |

* cited by examiner

ATHLETIC TRAINING SYSTEM

CROSS REFERENCE TO RELATED APPLICATION

This application claims the benefit of and takes priority from U.S. Provisional Patent Application Ser. No. 61/924,800 filed on Jan. 8, 2014, the contents of which are herein incorporated by reference.

BACKGROUND OF THE INVENTION

Field of the Invention

The present invention relates to a training system for the sport of lacrosse and particularly in both box and field lacrosse in women's and men's divisions.

Description of the Related Art

A variety of devices, methods and techniques are known for training athletes in every athletic event. These diverse devices, methods and techniques understandably vary with the individual sport, the country of origin and practice, as well as region and climate. Many systems may include mechanical or electrical systems and apparatuses to simulate game time situations or positions, and in particular to instruct players on the state of the art methods to gain winning advantages.

In particular, each specific athletic event possesses specific challenging positions or evolutions which require individualized training methods. The sport of lacrosse is no different. Lacrosse may be defined as specialized combination of basketball, soccer and hockey. Lacrosse is an enjoyable event, particularly as most people can play lacrosse since it requires a minimum of specialized equipment to participate at the novice level. The game requires and rewards coordination and agility. Quickness and speed are two highly prized qualities in lacrosse. An exhilarating sport, lacrosse is fast-paced and full of action. Long sprints up and down the field with abrupt starts and stops, precision passes and dodges are routine in men's and women's lacrosse. Lacrosse is played with a stick, which must be mastered by the player to throw, catch and scoop the ball, and a net mechanism.

Basically, two forms of lacrosse exist, box lacrosse and field lacrosse. Box Lacrosse can be described as the indoor version of the game played predominantly in Canada and is normally a much more physical game which is encased with walls that can be used to check a ball carrier into these confinements. Cross Checks are legal in Box Lacrosse. Field Lacrosse is played outdoors on numerous surfaces.

Again as in all athletic activities and events, lacrosse possesses a very distinct set of skills, including maneuvers which players must master to become an elite athlete within the sport, particularly during special evolutions including face-offs wherein player vie for possession of the lacrosse ball.

One particular maneuver, known as a clamp, or clamping in certain circles, is a tactical play utilized by opposing players to gain possession of the ball during a face-off. During a clamp, a face off player pushes back of the head over the ball and pulling the ball towards him.

Moreover, in the game of lacrosse, both teams have the chance of taking control of the ball after a goal, no matter what team scores. This is unlike other sports such as basketball, soccer or football, in which the ball is given to the team that was scored on. Therefore, in lacrosse, it is important for teams to practice getting control over a ball during a "face-off" (men's lacrosse) or "draw" (women's lacrosse). Of great import to technical skill and training purposes, in men's lacrosse, face-offs occur on the ground while in women's lacrosse, a "draw" occurs while players are standing up.

SUMMARY OF THE INVENTION

The instant apparatus and system, as illustrated herein, is clearly not anticipated, rendered obvious, or even present in any of the prior art mechanisms, either alone or in any combination thereof. The versatile system, method and series of apparatuses for creating and utilizing an athletic training apparatus are illustrated. Thus the several embodiments of the instant apparatus are illustrated herein.

It is an object of the instant system, and accompanying methods and apparatuses to afford players the ability to practice gaining possession of the ball at the beginning of the game and back after each score. This device is intended to allow a player to practice several important skills needed to be successful in the game of lacrosse. Structural elements of this device allow a player to practice endless repetitions of face-off and draw skills, while challenging the player to improve their form and quickness. This device is important because the player can practice on their own, without another player needed, as the device simulates an opponent.

It is an object of the instant system, and accompanying methods and apparatuses to afford players the ability to work against an opponent which possessions adjustable height and strength in order to hone the stick handling skill set and overall strength.

It is an object of the instant system to provide a device that simulates an opponent so that a player can repeatedly practice on the technical aspects of facing-off and draw control, without the presence of a practice partner or need for a field.

It is an additional object of the instant system to provide a physical simulation training mechanism for teams to practice getting control over a ball during a "face-off" (men's lacrosse) or "draw" (women's lacrosse).

It is an object of the instant system to provide a device, or series of devices, that are adaptable to face-offs which occur on the ground and draws which occur while players are standing in an upright position.

There has thus been outlined, rather broadly, the more important features of the versatile integrated athletic training system and series of accompanying devices and apparatuses and embodiments in order that the detailed description thereof that follows may be better understood, and in order that the present contribution to the art may be better appreciated. There are additional features of the invention that will be described hereinafter and which will form the subject matter of the claims appended hereto.

Thus, overall, this system and accompanying apparatuses are designed to be a portable training device used to practice the art of the face off in men's lacrosse. This device is designed to give both a visual reference as well as a physically realistic representation of an opponent as the user practices his moves against it. The design of the base allows the device to be easily transported and to stay in place with minimal movement as its being used. The lacrosse stick is attached to the base in such a way as to allow the stick to pivot in a realistic way as it is being used. The design of the attached spring gives the device an appropriate adjustable tension to give the user realistic resistance as he trains with it. A lacrosse stick is attached to the base at an angle. The angle of the stick forces the user to perform his face-off moves with proper and realistic technique. The machine allows the user to repetitively practice his face-off moves to improve his technique and hand speed.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

BRIEF DESCRIPTION OF THE DRAWINGS

The advantages of the present apparatus will be apparent from the following detailed description of exemplary embodiments thereof, which description should be considered in conjunction with the accompanying drawings, in which: having thus described the system in general terms, reference will now be made to the accompanying drawings, which are not necessarily drawn to scale, and wherein.

DETAILED DESCRIPTION OF THE SEVERAL EMBODIMENTS

Figure 1:
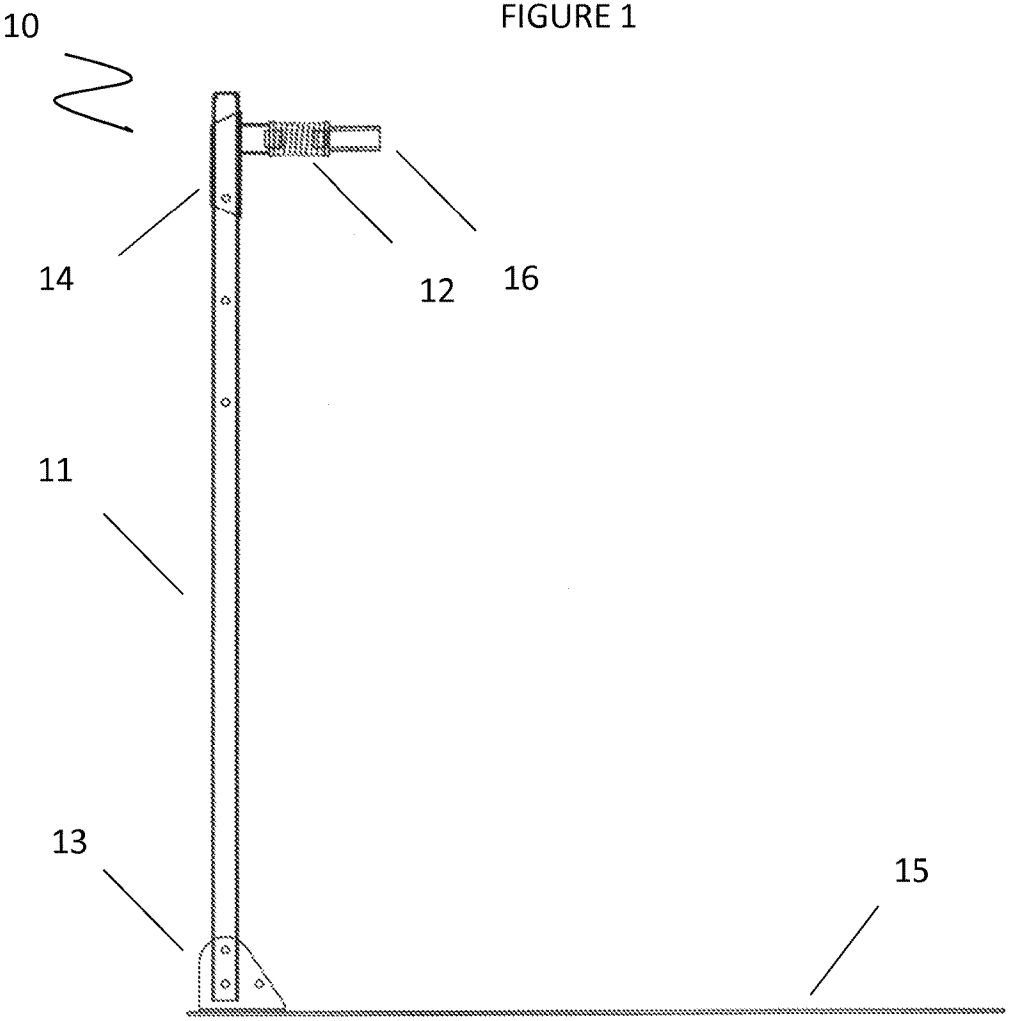
FIG. 1 illustrates a side view of a standard practice stand mechanism of the instant invention.

FIG. 1 illustrates a side view of a standard stand mechanism 10 of this invention, comprising an upright 11, a bracket 13 for retaining the upright, a base plate apparatus 15 in mechanical communication with a lower portion of the set of uprights; and, a compression/expansion mechanism, such as a torsion bar, torsion rod or spring mechanism 12 and head 16 may further comprise an adjustment mechanism 14 for adjusting the position of the spring and head mechanism.

Figure 2:
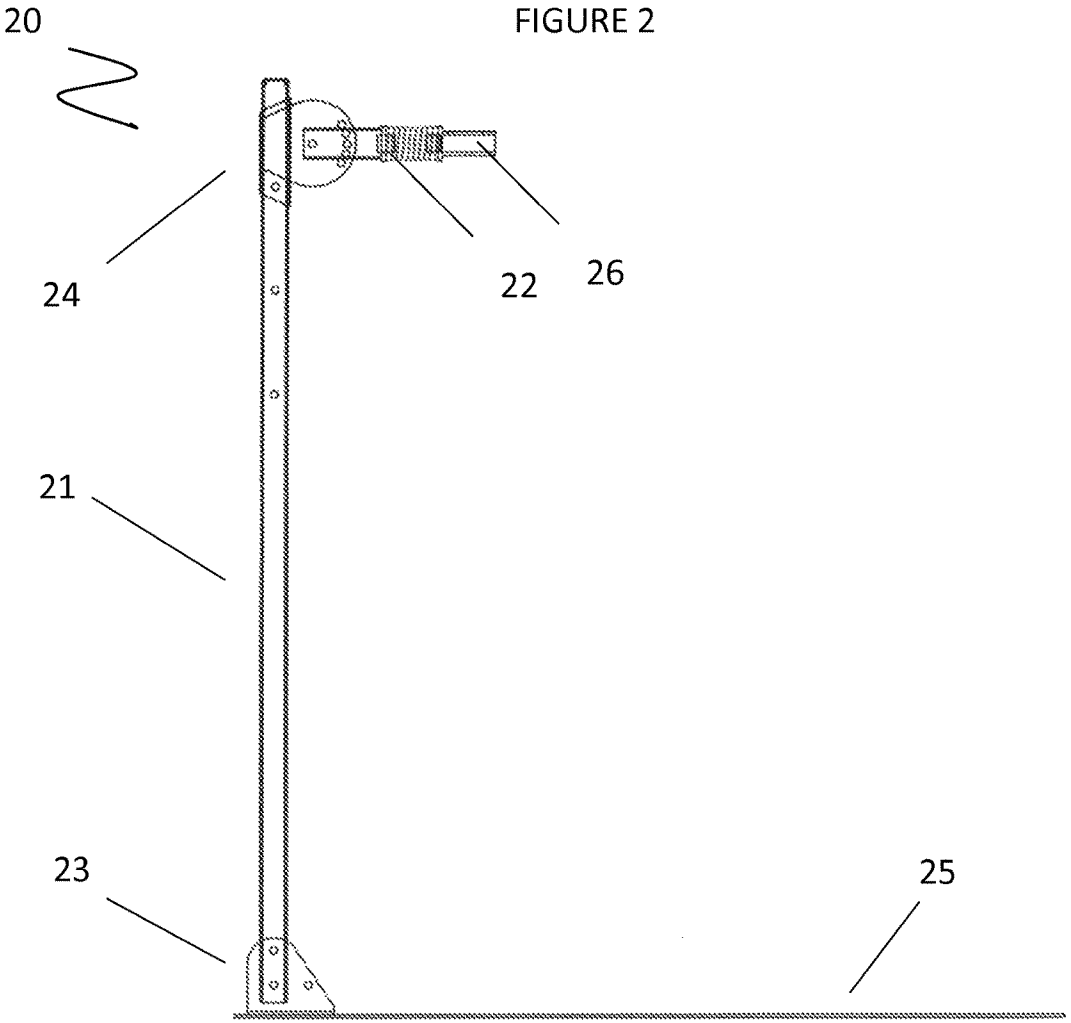
FIG. 2 illustrates a side view of a professional practice stand mechanism of the instant invention.

FIG. 2 illustrates a side view of a standard stand mechanism 20 of this invention, comprising an upright 21, a bracket 23 for retaining the upright, a base plate apparatus 25 in mechanical communication with a lower portion of the set of uprights; and, a spring mechanism 22 and head 26 may further comprise an adjustment mechanism 24 for adjusting the position of the spring and head mechanism.

Figure 3A:
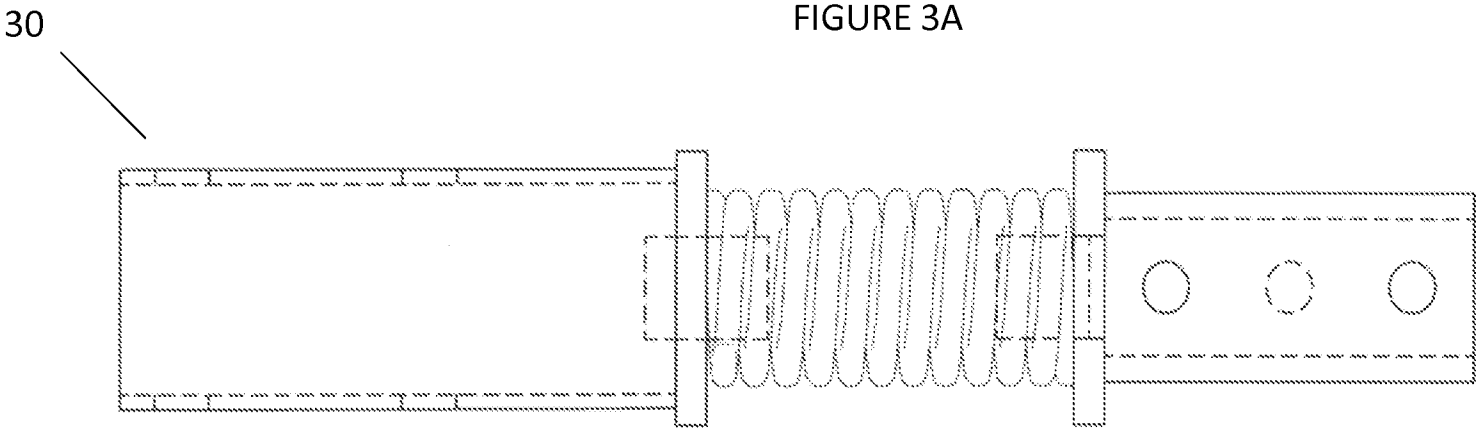
FIG. 3A illustrates a side view of a low density spring and head assembly or system of the instant invention.
Figure 3B:
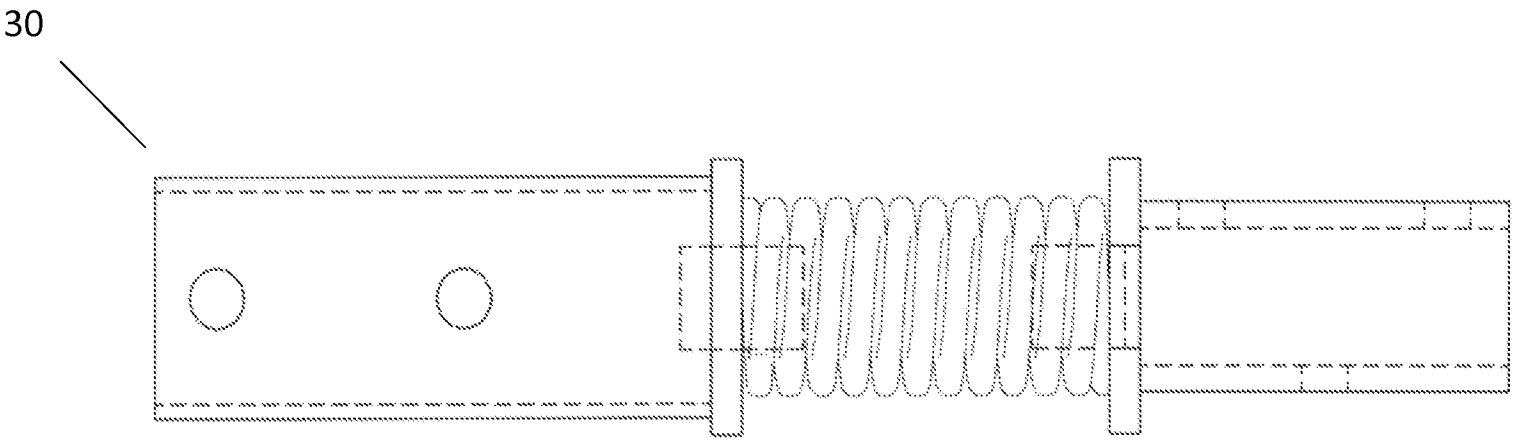
FIG. 3B illustrates an additional side view of a low density spring and head assembly or system of the instant invention.

FIG. 3A illustrates a side view of a low density spring and head assembly or system and head assembly or system 30 of this invention. FIG. 3B illustrates an additional side view of a low density spring and head assembly or system 30 of this invention.

Figure 4A:
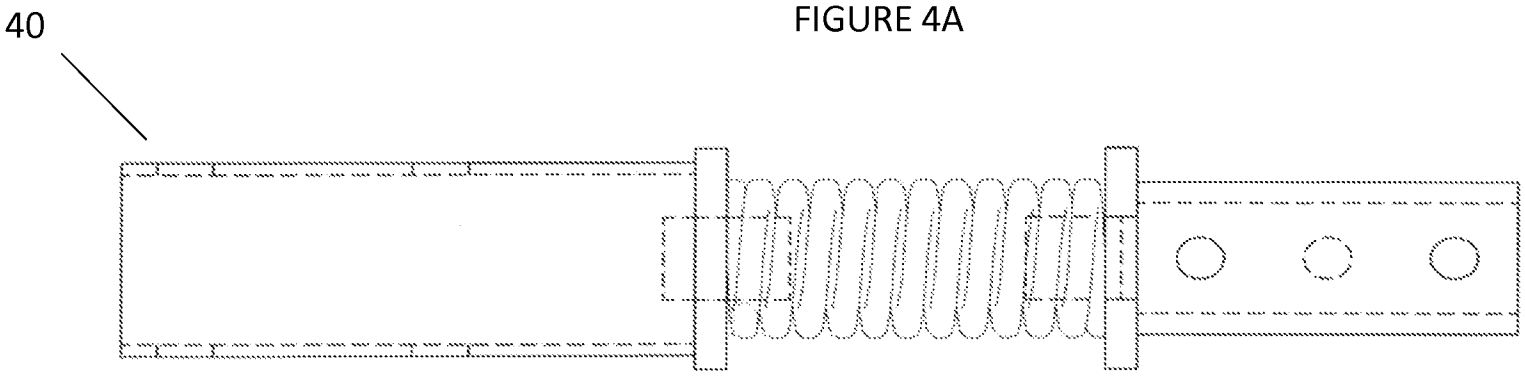
FIG. 4A illustrates a side view of a high density spring and head assembly or system of the instant invention.
Figure 4B:
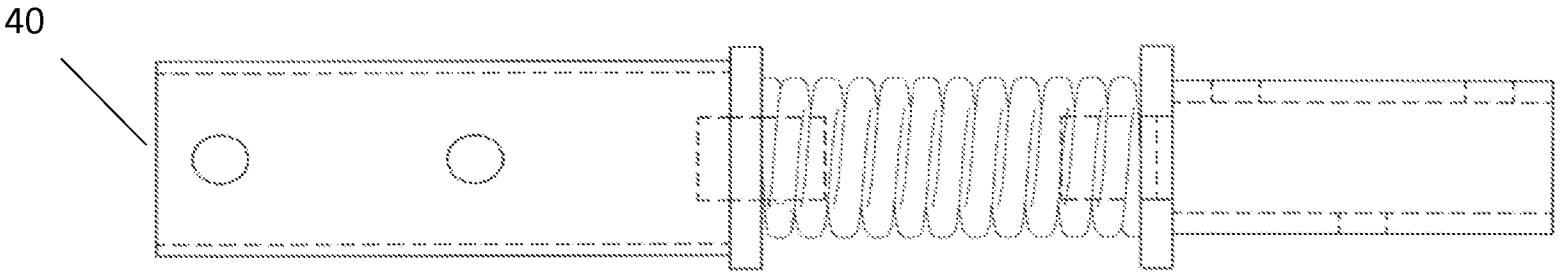
FIG. 4B illustrates an additional side view of a high density spring and head assembly or system of the instant invention.

FIG. 4A illustrates a side view of a high density spring and head assembly or system 40 of this invention. FIG. 4B illustrates an additional side view of a high density spring and head assembly or system 40 of this invention.

Figure 5A:
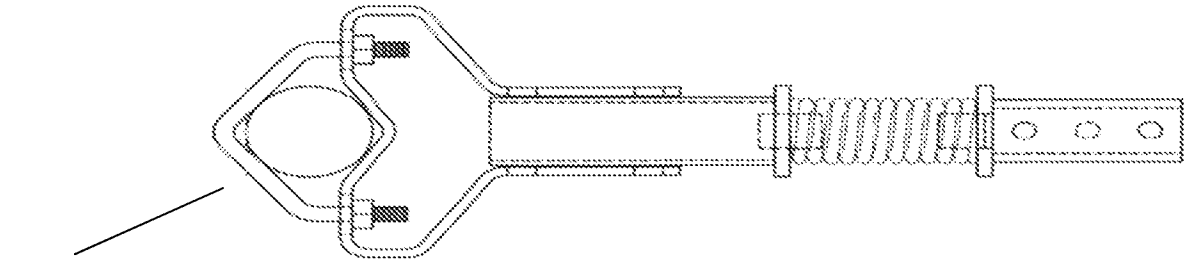
FIG. 5A illustrates a top plan view of one embodiment of a goal style clamp simulator of this invention.

FIG. 5A illustrates a top plan view of one embodiment of a goal style clamp simulator 50 of this invention which illustrates an adjustable rotational moment around an upright member in order to provide three hundred and sixty degrees (360°) of rotation in the horizontal plane. In this manner, the user is afforded practice at almost infinite arrangement for strength and agility training.

Figure 5B:
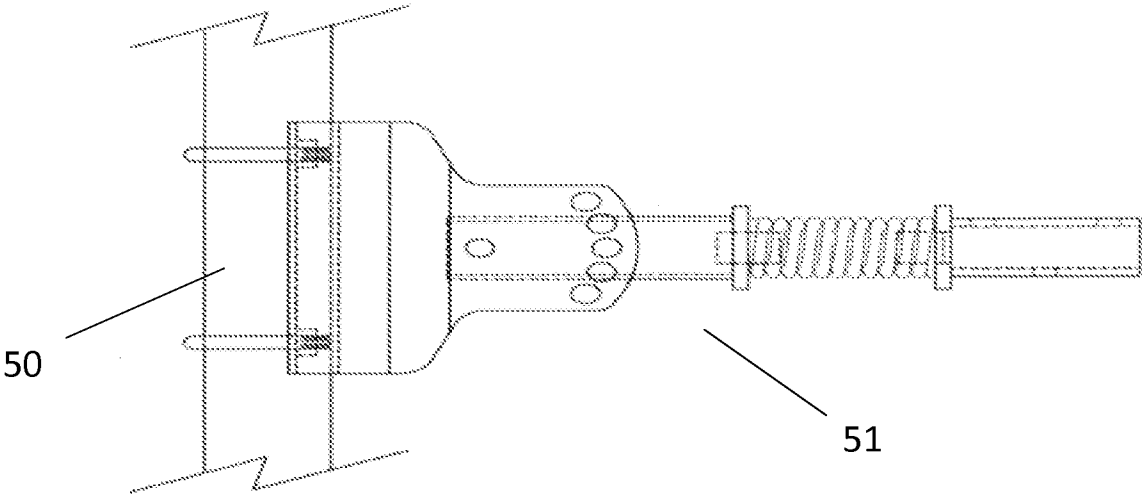
FIG. 5B illustrates a side view of an additional embodiment of a goal style clamp simulator of this invention.

FIG. 5B illustrates a side view of one embodiment of a goal style clamp simulator 50 of this invention which illustrates an adjustable rotational moment around a, upright member in order to provide one hundred and eighty degrees (180°) of rotation in the vertical plane. In this manner, the user is afforded practice at a wide range of heights for strength and agility training.

Figure 6:
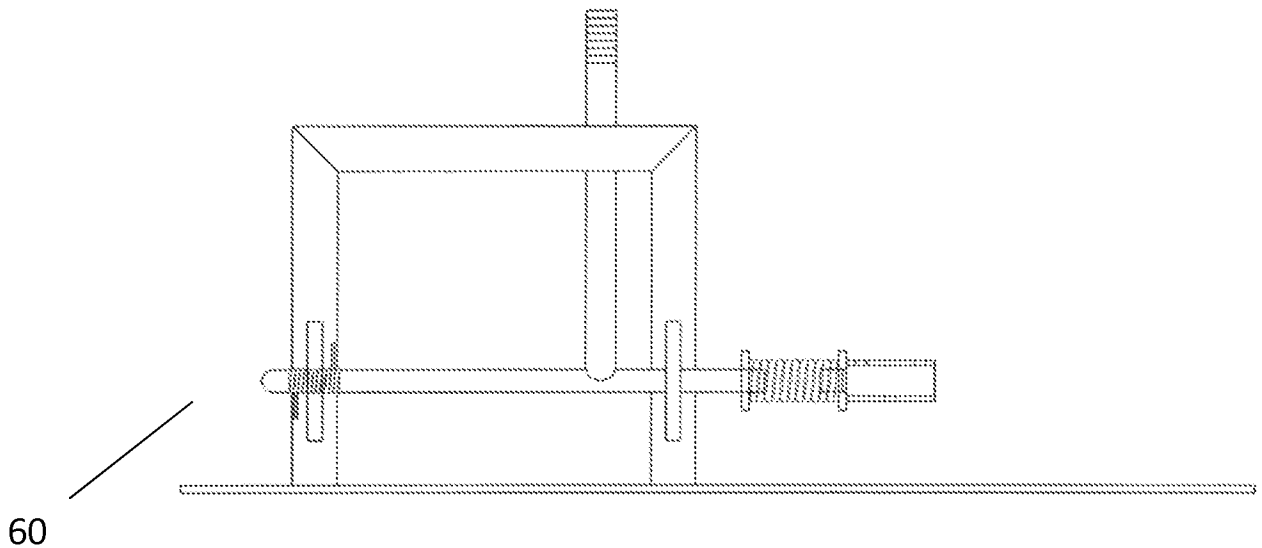
FIG. 6 illustrates a side view of the professional style base training apparatus of this invention.

Thus when coupling the vertical and horizontal both adjust with the adjustable spring strength feature, a player can develop a system of training at numerous intervals in to build different skills and muscle groups. Moreover, FIG. 6 illustrates a side view of the professional style base training apparatus 60 of this invention.

Figure 7A:
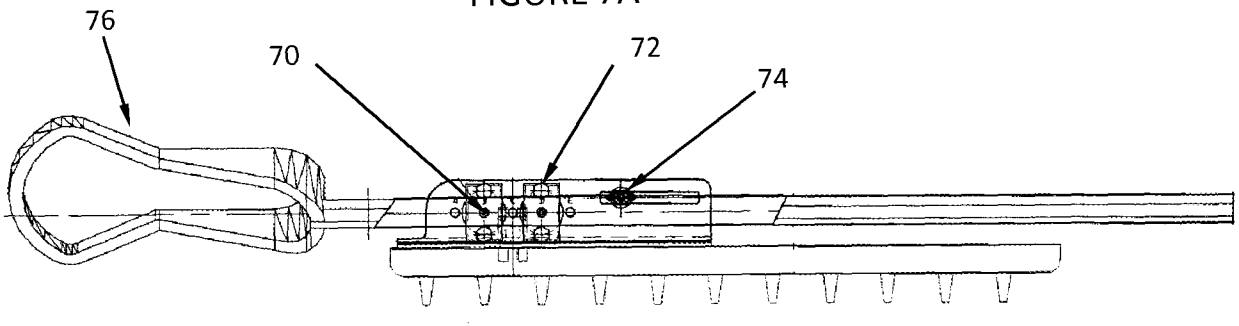
FIG. 7A illustrates a top plan view of the stick attachment mechanism of this invention.

FIG. 7A illustrates a top plan view of the stick attachment mechanism used for standard surface practice. A standard issue lacrosse stick 76 is attached by a pipe dampening clamp 72 permitting stick placement. There is also an optional set screw 70 in order to lock the lacrosse stick into a desired position. There is a slotted adjustment mechanism 74 used for a spring anchor that is adjusted based on skill set.

Figure 7B:
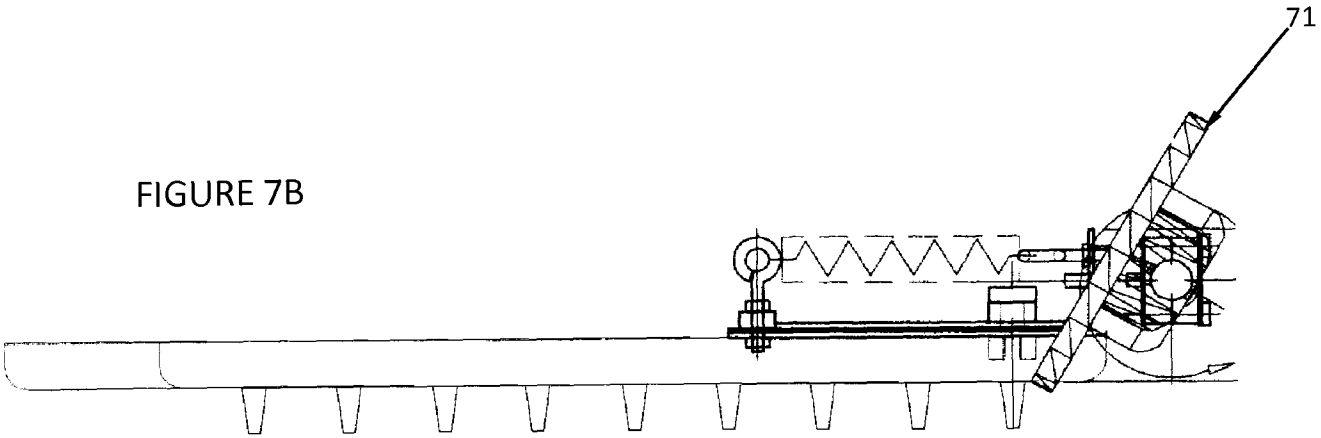
FIG. 7B illustrates a side view of the stick attachment mechanism of this invention; and, FIG. 8 illustrates a top plan view of one embodiment of a standard surface practice mechanism for lacrosse face-offs of the instant invention.

FIG. 7B illustrates a side view of the stick attachment mechanism used for standard surface practice. The rotation mechanism 71 allows for the lacrosse stick to be rotated to desired angles. In this manner, the user is afforded practice at a wide range of angles for strength and agility training.

Figure 8:
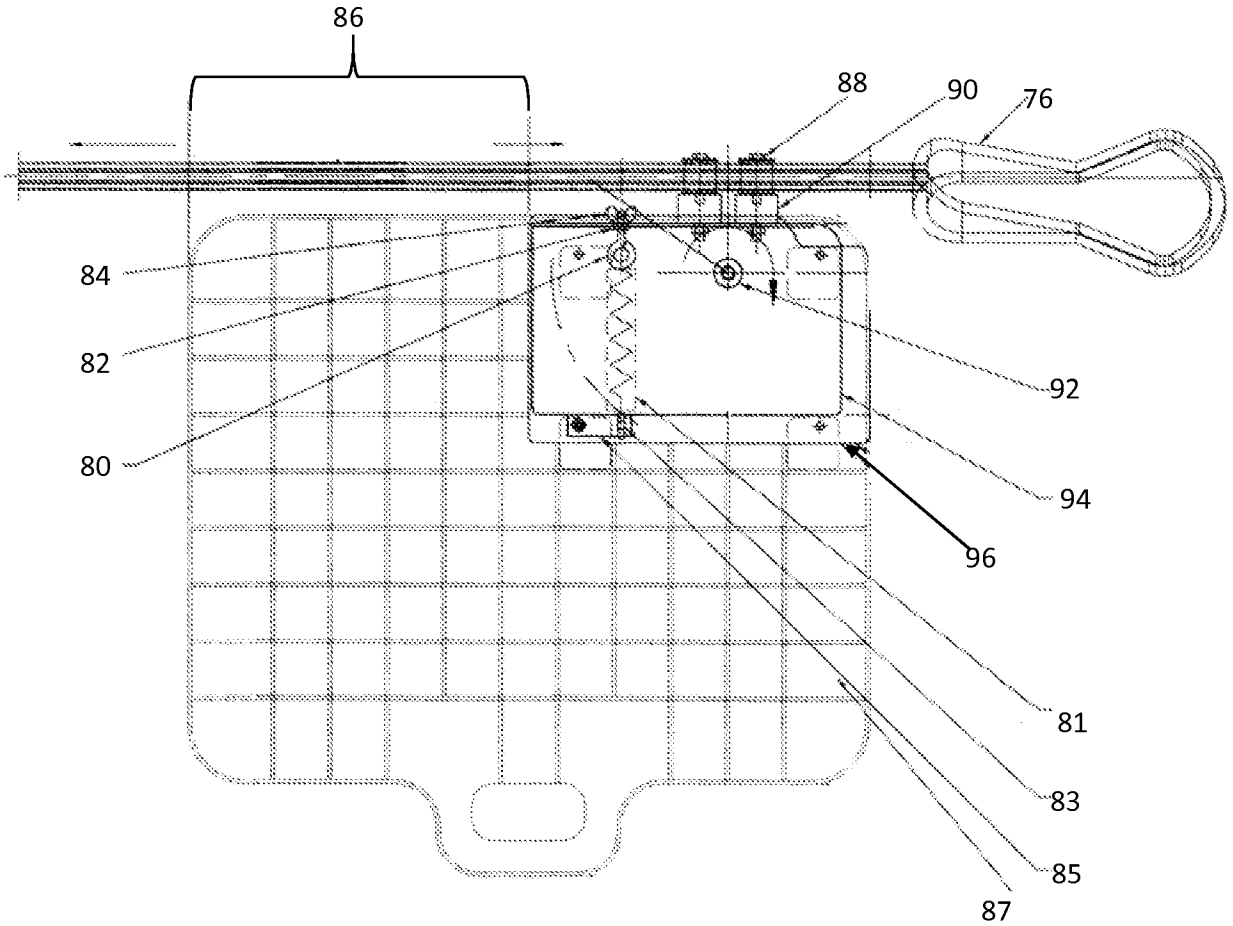

FIG. 8 illustrates a top plan view of one embodiment of a standard surface practice mechanism for lacrosse face-offs. A standard issue lacrosse stick 76 is attached to a base plate 96 by pipe damping clamps 88. The lacrosse stick position length and rotation is adjustable 86. On top of the base plate 96 is a pivot plate 94 which has the shoulder bolt 92 for pivoting, vibration mounts 90, a PVC clear pipe over an extension spring 81 which connects to a formed eye 83 for a spring mount, an eyebolt 80, a slotted T-nut 82, and wing nut 84 which allows for the lacrosse stick to rotate to a desired angle for practice. The base plate 96 is attached to a purchased cleat cleaning base 87 by a stop block 85.

Thus, the instant device simulates an opponent so that a player can repeatedly practice, on their own, the technical aspects of facing-off and draw control. In men's lacrosse, face-offs occur on the ground. In women's lacrosse, a "draw" occurs while players are standing up.

Investigating some further elements, in the men's device, two (2) separate designs exist. The first is initiated when the player touches the device stick 76. This action will set the spring 81 off and start the rotation of the clamp 88. The second men's device is sound activated and will initiate the rotation of the clamp on demand.

Turning to the women's device, three (3) models exist to date as follows: a Premium model, which is adjustable to over 50 positions; a Back Yard Model, which is a lighter model with 3 adjustments; and, a Goal Model, which utilizes same technology but clamps on existing an existing goal.

And the structural elements of some embodiments of the instant device are as follows:

a.) Steel/Aluminum Plate for bottom of device available in various weights b.) Brackets for Steel/Aluminum uprights c.) Steel/Aluminum uprights d.) Spring that rotates 360 degrees e.) The boy's device has a lever to reset the spring f.) The boy's device has spring by lacrosse head for simulating other players stick g.) The boy's device has an adjustable spring that can be changed depending on skill level for training and rotates lacrosse head 90 degrees to simulate clamp, this device can be used for youth player up to college level h.) Women's Device is fully adjustable to 50 different positions depending on what height, weight, or angle your opponent may be. Also allows for taller or shorter players to have similar angles to practice on.

Investigating the usage parameters for the different embodiments:

a.) Women's Device: The player uses her lacrosse stick to push on the device stick in order to start the motion. The device's spring then simulates the action of an opponent pushing back 360 degrees. The springs help the player practice pushing or pulling the ball to any direction straight in the air or to any side.

b.) Men's Device: The player uses his stick to release the spring which in turn simulates the opponent's movement (what's called "clamping" during a face-off). There is also a model that is sound activated and the training tool is initiated from a coach or player. There is a pressure spring that can be tightened or loosened depending on strength and skill level of the athlete.

What is claim is:

1. A lacrosse training apparatus comprising:

an upright;

a bracket for retaining the upright;

a base plate apparatus in mechanical communication with a lower portion of the upright;

a spring mechanism;

a set of pipe damping clamps, wherein the set of pipe damping clamps is configured to attach a lacrosse stick to the base plate; and a pivot plate located on top of the base plate, wherein the pivot plate further comprises a shoulder bolt and vibration mounts.

2. The lacrosse training apparatus of claim 1 wherein the plate comprises a material selected from the group consisting of semi-malleable metal, aluminum, alloys, polymers and composite materials.

3. The lacrosse training apparatus of claim 1 wherein the upright comprises a material selected from the group consisting of semi-malleable metal, aluminum, alloys, polymers and composite materials.

4. The lacrosse training apparatus of claim 1 wherein the spring mechanism is rotatably mounted.

5. The lacrosse training apparatus of claim 1 wherein the spring mechanism rotates a range of zero to three hundred and sixty degrees.

6. The lacrosse training apparatus of claim 1 wherein the spring mechanism comprises a reset lever to reset the spring mechanism.

7. The lacrosse training apparatus of claim 1 wherein the apparatus comprises a lacrosse head for simulating another player's stick.

8. The lacrosse training apparatus of claim 7 wherein the apparatus comprises a pivot mechanism for rotation of the lacrosse stick to a desired angle for stimulating an opposing player's stick.

9. The lacrosse training apparatus of claim 1 wherein the device is fully adjustable to 50 different positions depending on what height, weight, or angle of opponent.

10. A method of lacrosse training comprising the steps of:

utilizing a resistance training mechanism consisting of;

an upright;

a bracket for retaining the upright;

a base plate apparatus in mechanical communication with a lower portion of the upright;

a spring mechanism;

a set of pipe damping clamps, wherein the set of pipe damping clamps is configured to attach a lacrosse stick to the base plate; and a pivot plate located on top of the base plate, wherein the pivot plate further comprises a shoulder bolt and vibration mounts; and positioning a user opposite to resistance training mechanism;

defining a practice evolution;

selecting the corresponding height for the resistance training mechanism; and, selecting the corresponding spring tension for the resistance training mechanism.

11. The method of lacrosse training of claim 9 wherein the evolution is selected from the group consisting of face-offs, draws, and angled evolutions.

* * * * *